US012650126B2

(12) United States Patent
Haseley et al.

(10) Patent No.: US 12,650,126 B2
(45) Date of Patent: Jun. 9, 2026

(54) ELECTRIC COMPRESSOR WITH PASSIVE PRESSURE SYSTEM BETWEEN HIGH AND LOW PRESSURE REGIONS

(71) Applicant: MAHLE INTERNATIONAL GMBH, Stuttgart (DE)

(72) Inventors: Brent Haseley, Niagara Falls, NY (US); Jonathan Hammond, Churchville, NY (US)

(73) Assignee: MAHLE INTERNATIONAL GMBH (DE)

( * ) Notice: Subject to any disclaimer, the term of this patent is extended or adjusted under 35 U.S.C. 154(b) by 0 days.

(21) Appl. No.: 18/623,186

(22) Filed: Apr. 1, 2024

(65) Prior Publication Data

US 2025/0270995 A1 Aug. 28, 2025

Related U.S. Application Data

(60) Provisional application No. 63/557,654, filed on Feb. 26, 2024.

(51) Int. Cl.
*F04C 18/02* (2006.01)
*F04C 28/24* (2006.01)
*F04C 28/26* (2006.01)

(52) U.S. Cl.
CPC ..... *F04C 18/0215* (2013.01); *F04C 18/0246* (2013.01); *F04C 28/24* (2013.01);
(Continued)

(58) Field of Classification Search
CPC .. F04C 18/0215; F04C 18/0246; F04C 28/24; F04C 28/26; F04C 2240/30; F04C 2240/403; F04C 2240/50
See application file for complete search history.

(56) References Cited

U.S. PATENT DOCUMENTS 4,741,674 A * 5/1988 Tischer ..... F25B 41/24 417/427
5,503,542 A * 4/1996 Grassbaugh ..... F04C 18/0215 417/310

(Continued)

FOREIGN PATENT DOCUMENTS

DE 102018116630 A1 1/2020
EP 1382854 A2 1/2004

(Continued)

OTHER PUBLICATIONS

Foreign Patent Publication and Machine Translation for KR 10-2020-0137791 A: 1st Inventor: Kim; Title: Electric Compressor; Published Dec. 9, 2020. (Year: 220).*

(Continued)

*Primary Examiner* — Mary A Davis
(74) *Attorney, Agent, or Firm* — Endurance Law Group PLC; James R. Yee

(57) ABSTRACT

An electric compressor includes a housing, refrigerant inlet port, a refrigerant outlet port, an inverter section, a motor section, a compression device, and a passive pressure system. The refrigerant inlet port is coupled to the housing and is configured to introduce the refrigerant to the intake volume. The compression device is a scroll-type compression device configured to compress the refrigerant. The refrigerant outlet port is coupled to the housing and is configured to allow compressed refrigerant to exit the scroll-type electric compressor from the discharge volume. The passive pressure system is located within the compression device and has a first end located adjacent the intake volume and a second end located adjacent the discharge volume. The passive pressure system is configured to automatically open a passage between the discharge volume and the intake (Continued)

volume allowing compressed refrigerant to be recycled into the intake volume.

18 Claims, 10 Drawing Sheets

(52) U.S. Cl.
CPC ..... *F04C 28/26* (2013.01); *F04C 2240/30* (2013.01); *F04C 2240/403* (2013.01); *F04C 2240/50* (2013.01)

(56) References Cited

U.S. PATENT DOCUMENTS

| | | | | |
|---|---|---|---|---|
| 5,855,475 | A | 1/1999 | Fujio et al. | |
| 6,132,191 | A * | 10/2000 | Hugenroth | F04C 29/126 137/220 |
| 6,478,550 | B2 | 11/2002 | Matsuba et al. | |
| 6,896,498 | B1 | 5/2005 | Patel | |
| 7,510,382 | B2 | 3/2009 | Jeong | |
| 7,547,202 | B2 | 6/2009 | Knapke | |
| 8,007,261 | B2 | 8/2011 | Caillat | |
| 8,162,636 | B2 | 4/2012 | Yokoi et al. | |
| 8,535,029 | B2 | 9/2013 | Ohno et al. | |
| 9,194,395 | B2 | 11/2015 | Ginies et al. | |
| 9,790,940 | B2 | 10/2017 | Doepker et al. | |
| 9,926,932 | B2 | 3/2018 | Perevozchikov et al. | |
| 9,957,962 | B2 | 5/2018 | Choi et al. | |
| 10,087,936 | B2 | 10/2018 | Pax et al. | |
| 10,378,540 | B2 | 8/2019 | Stover et al. | |
| 10,378,542 | B2 | 8/2019 | Stover et al. | |
| 10,598,180 | B2 | 3/2020 | Stover et al. | |
| 10,662,946 | B2 * | 5/2020 | Nakagami | F04C 28/08 |
| 2005/0019177 | A1 | 1/2005 | Shin et al. | |
| 2007/0140872 | A1 * | 6/2007 | Hutt | F04C 28/26 417/310 |
| 2016/0169227 | A1 | 6/2016 | Cho et al. | |
| 2020/0277955 | A1 | 9/2020 | Kozalla et al. | |

FOREIGN PATENT DOCUMENTS

| | | | |
|---|---|---|---|
| EP | 1170560 | B1 | 9/2005 |
| EP | 1936197 | A1 | 6/2008 |
| EP | 2213879 | A1 | 8/2010 |
| EP | 1433956 | B1 | 2/2012 |
| EP | 2541066 | A1 | 1/2013 |
| EP | 2554849 | A2 | 2/2013 |
| EP | 1698784 | B1 | 3/2013 |
| EP | 2642128 | B1 | 4/2015 |
| EP | 1498610 | B1 | 8/2015 |
| EP | 2307728 | B1 | 8/2016 |
| EP | 2307730 | B1 | 10/2017 |
| EP | 2417356 | B1 | 9/2018 |
| EP | 2539590 | B1 | 9/2020 |
| JP | 2003074482 | A | 3/2003 |
| JP | 2008175496 | A | 7/2008 |
| JP | 2010196593 | A | 9/2010 |
| JP | 2013167215 | B | 12/2015 |
| KR | 20040035177 | A | 4/2004 |
| KR | 20070019603 | A | 2/2007 |

OTHER PUBLICATIONS

Extended European Search Report in corresponding EP Patent Application No. 25157977.7, issued Jun. 3, 2025, 11 pages.

* cited by examiner

ELECTRIC COMPRESSOR WITH PASSIVE PRESSURE SYSTEM BETWEEN HIGH AND LOW PRESSURE REGIONS

CROSS REFERENCE TO RELATED APPLICATIONS

This application claims priority to U.S. Provisional Patent Application Ser. No. 63/557,654 filed on Feb. 26, 2024, the entire disclosure of which is hereby incorporated by reference and relied upon.

FIELD OF THE INVENTION

The invention relates generally to electric compressor, and more particularly to an electric compressor that compresses a refrigerant using a scroll compression device.

BACKGROUND OF THE INVENTION

Compressors have long been used in cooling systems. In particular, scroll-type compressors, in which an orbiting scroll is rotated in a circular motion relative to a fixed scroll to compress a refrigerant, have been used in systems designed to provide cooling in specific areas. For example, such scroll-type compressors have long been used in the HVAC systems of motor vehicles, such as automobiles, to providing air-conditioning. Such compressors may also be used in applications requiring a heat pump. Generally, these compressors are driven using rotary motion derived from the automobile's engine.

With the advent of battery-powered or electric vehicles and/or hybrid vehicles, in which the vehicle may be solely powered by a battery at times, such compressors must be driven or powered by the battery rather than an engine. Such compressors may be referred to as electric compressors.

In addition to cooling a passenger compart of the motor vehicle, electric compressors may be used to provide heating or cooling to other areas or components of the motor vehicle. For instance, it may be desired to heat or cool the electronic systems and the battery or battery compartment, when the battery is being charged, especially during fast charging modes, as such generate heat which may damage or degrade the battery and/or other system. It may also be used to cooling the battery during times when the battery is not being charged or used, as heat may damage or degrade the battery. Since the electric compressor may be run at various times, even when the motor vehicle is not in operation, such use, obviously, requires electrical energy from the battery, thus reducing the operating time of the battery.

Generally, such compressors may be operated as a heat pump, for example, to move heat from outside a vehicle to the inside of the vehicle, i.e., the vehicle compartment. An electric compressor may be divided into a suction side and a discharge side. The suction side may be at least partially defined by an intake volume and the discharge side may be at least partially defined by a discharge volume. Refrigerant is introduced into the compressor via the intake volume, compressed, and discharged from the compressor via the discharge volume. Heat pump operation or efficiency may be limited by the saturation temperature of the refrigerant on the suction side.

Additionally, electric compressors may run at a very high speed, e.g., 2,000 RPM (or higher). Such high speed may generate unwanted levels of noise. It is thus desirable, to provide an electric compressor having high efficiency, low-noise and maximum operating life. The present invention is aimed at one or more of the problems or advantages identified above.

BRIEF SUMMARY OF THE INVENTION

In a first embodiment of the present invention, a scroll-type electric compressor configured to compress a refrigerant and to be operated as a heat pump is provided. The scroll-type compressor includes a housing a refrigerant inlet port, a refrigerant outlet port, an inverter module, a motor, a drive shaft, a compression device, and a passive pressure system. The housing defines an intake volume and a discharge volume and has a generally cylindrical shape. The refrigerant inlet port is coupled to the housing and configured to introduce the refrigerant to the intake volume. The refrigerant outlet port is coupled to the housing and configured to allow compressed refrigerant to exit the scroll-type electric compressor from the discharge volume. The inverter module is mounted inside the housing and adapted to convert direct current electrical power to alternating current electrical power. The motor is mounted inside the housing. The drive shaft is coupled to the motor. The compression device has a compression device body and is coupled to the drive shaft. The compression device receives the refrigerant from the intake volume and compresses the refrigerant as the drive shaft is rotated by the motor. The compression device body at least partially defines the intake volume and the discharge volume. The passive pressure system is located within the compression device body and has a first end located adjacent the intake volume and a second end located adjacent the discharge volume. The passive pressure system is configured to automatically open a passage between the discharge volume and the intake volume allowing compressed refrigerant to be recycled into the intake volume.

In a second embodiment of the present invention, a scroll-type electric compressor configured to compress a refrigerant is provided. The electric compressor includes a housing, a refrigerant inlet port, a refrigerant outlet port, an inverter section, an inverter module, and a passive pressure system. The housing defines an intake volume and a discharge volume. The refrigerant inlet port is coupled to the housing and configured to introduce refrigerant to the intake volume. The refrigerant outlet port is coupled to the housing and configured to allow compressed refrigerant to exit the scroll-type electric compressor from the discharge volume.

The inverter section includes an inverter housing, an inverter back cover, and an inverter module. The inverter back cover is connected to the inverter housing and forms an inverter cavity. The inverter module is mounted inside the inverter cavity and adapted to convert direct current electrical power to alternating current electrical power.

The motor section includes a motor housing forms a motor cavity and is mounted to the inverter housing. The drive shaft is located within the motor housing and has a central axis. The motor is located within the motor housing to controllably rotate the drive shaft about the central axis. The compression device includes a fixed scroll and an orbiting scroll. The fixed scroll is located within, and being fixed relative to, the housing. The orbiting scroll is coupled to the drive shaft. The orbiting scroll and the fixed scroll form compression chambers for receiving the refrigerant from the intake volume and compressing the refrigerant as the drive shaft is rotated about the central axis.

The passive pressure system is located within the compression device body and has a first end located adjacent the intake volume and a second end located adjacent the discharge volume. The passive pressure system is configured to automatically open a passage between the discharge volume and the intake volume allowing compressed refrigerant to be recycled into the intake volume.

BRIEF DESCRIPTION OF THE SEVERAL VIEWS OF THE DRAWINGS

These and other features and advantages of the present invention will become more readily appreciated when considered in connection with the following detailed description and appended drawings.

DETAILED DESCRIPTION OF THE INVENTION

Figure 1:
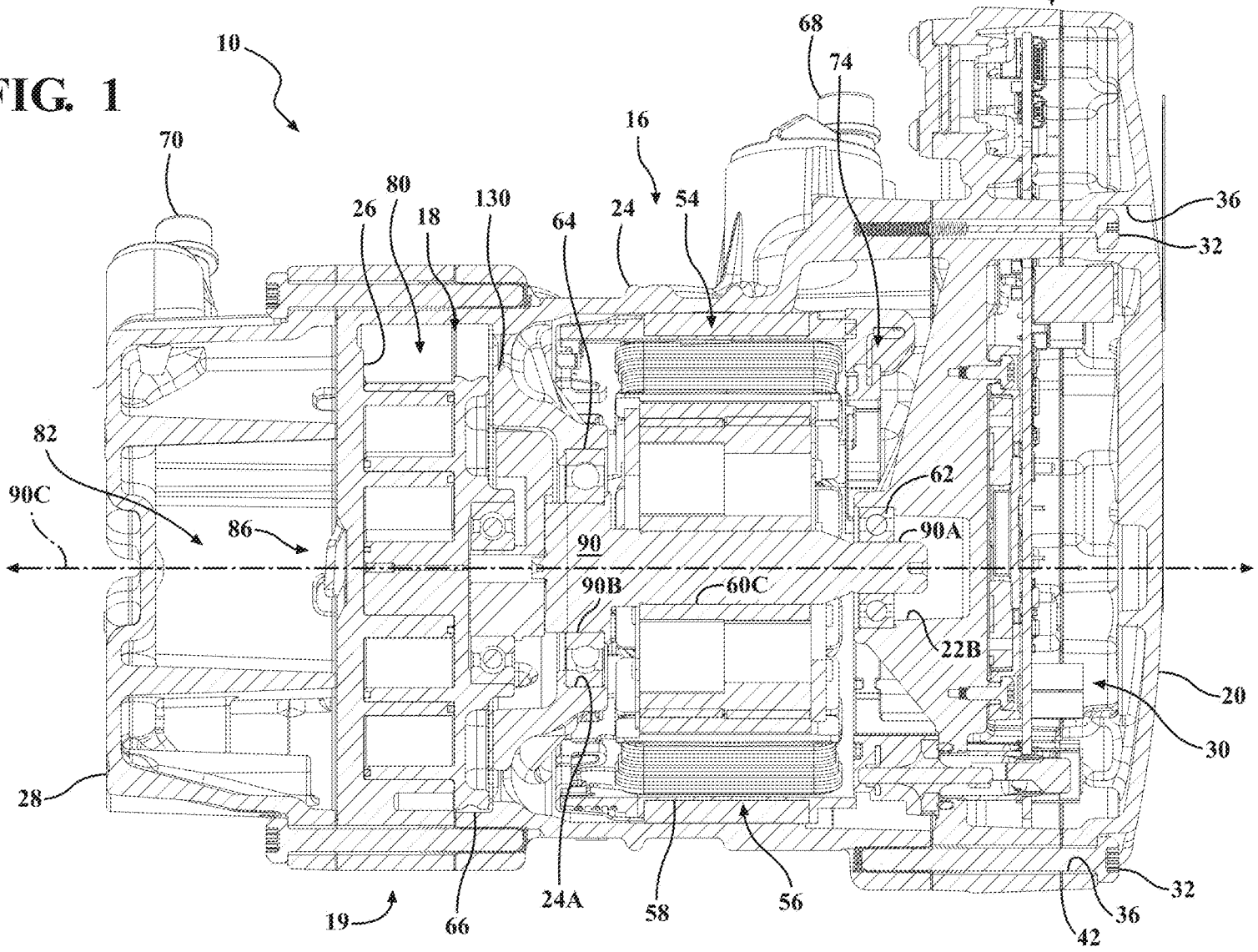
FIG. 1 is a cross-sectional view of an electric compressor.

Referring to the FIGS. 1-10, wherein like numerals indicate like or corresponding parts throughout the several views, an electric compressor 10 having an outer housing 12 is provided. The electric compressor 10 is particularly suitable in a motor vehicle, such as an automotive vehicle (not shown). The electric compressor 10 may be used as a cooling device or as a heating pump to heat and/or cool different aspects of the vehicle. For instance, the electric compressor 10 may be used as part of the heating, ventilation and air conditioning (HVAC) system in electric vehicles (not shown) to cool or heat a passenger compartment. In addition, the electric compressor 10 may be used to heat or cool the passenger compartment, on-board electronics and/or a battery used for powering the vehicle while the vehicle is not being operated, for instance, during a charging cycle. The electric compressor 10 may further be used while the vehicle is not being operated and while the battery is not being charged to maintain, or minimize the degradation, of the life of the battery.

In the illustrated embodiment, the electric compressor 10 is a scroll-type compressor acts to compress a refrigerant rapidly and efficiently for use in different systems of a motor vehicle, for example, an electric or a hybrid vehicle. The electric compressor 10 includes an inverter section 14, a motor section 16, and a compression device (or compression assembly) 18 contained within the outer housing 12. The outer housing 12 includes an inverter back cover 20, an inverter housing 22 and a center housing 24 (which may be integral), a front cover 28 (which may be referred to as the discharge head). The center housing 24 houses the motor section 16 and the compression device 28.

In one embodiment, the inverter back cover 20, the inverter housing 22, the center housing 24, and the front cover 28 are composed from machined aluminum. The inverter 10 may be mounted, for example, within the body of a motor vehicle, via a plurality of mount points (not shown). In one aspect of the electric compressor 10 of the disclosure, an electric compressor 10 having a scroll back-pressure system 150 (see below) is provided.

In one aspect of the present invention, the compressor 10 includes a passive pressure system 150. As discussed in more detail below, the passive pressure system 150 is configured to automatically open a passage between a discharge volume 82 and the intake volume 74 allowing compressed refrigerant to be recycled into the intake volume.

General Arrangement, and Operation, of the Electric Compressor 10

The inverter back cover 20 and the inverter housing 22 form an inverter cavity 30. The inverter back cover 20 is mounted to the inverter housing 22 by a plurality of bolts 32. An inverter gasket 42, positioned between the inverter back cover 20 and the inverter housing 22 keeps moisture, dust, and other contaminants from the inverter cavity 30.

An inverter module (not shown) mounted within the inverter cavity 30 formed by the inverter back cover 20 and the inverter housing 22. The inverter module may include an inverter circuit (not shown) mounted on a printed circuit board (not shown), which is mounted to the inverter housing 22. The inverter circuit converts direct current (DC) electrical power received from outside of the electric compressor 10 into three-phase alternating current (AC) power to supply/power a motor 54 (see below). The inverter circuit may also control the rotational speed of the electric compressor 10. High voltage DC current is supplied to the inverter circuit via a high voltage connector (not shown). Low voltage DC current to drive the inverter circuit, as well as control signals to control operation of the inverter circuit, and the motor section 16, may be supplied via a low voltage connecter (not shown).

The center housing 24 forms a motor cavity 56. The motor section 16 includes a motor 54 located within the motor cavity 56. With specific reference to FIG. 12, in the illustrated embodiment, the motor 54 is a three-phase AC motor having a stator 58. The stator 58 has a generally hollow cylindrical shape with six individual coils (two for each phase). The stator 58 is contained within, and mounted to, the motor housing 22 and remains stationery relative to the motor housing 22.

The motor 54 includes a rotor 60 located within, and centered relative to, the stator 58. The rotor 60 has a generally hollow cylindrical shape and is located within the stator 58.

A drive shaft 90 is coupled to the rotor 60 and rotates therewith. In the illustrated embodiment, the draft shaft 90 is press-fit within a center aperture 60C of the rotor 60. The drive shaft 90 has a first end 90A and a second end 90B. The inverter housing 22 includes a first drive shaft supporting member 22B located on the motor side of the inverter housing 22. A first ball bearing 62 located within an aperture formed by the first drive shaft supporting member 22 supports and allows the first end of the drive shaft 90 to rotate. The center housing 24 includes a second drive shaft supporting member 24A. A second ball bearing 64 located within an aperture formed by the second drive shaft supporting member 24A allows the second end 90B of the drive shaft 90 to rotate. In the illustrated embodiment, the first and second ball bearing 62, 64 are press-fit with the apertures formed by the first drive shaft supporting member 22 of the inverter housing 22 and the second drive shaft supporting member 24A of the center housing 24, respectively.

As stated above, the electric compressor 10 is a scroll-type compressor. The compression device 18 includes the fixed scroll 26 and an orbiting scroll 66. The orbiting scroll 66 is fixed to the second end of the rotor 60B. The rotor 60 with the drive shaft 90 rotate to drive the orbiting scroll 66 motion under control of the inverter module rotate.

The drive shaft 90 has a central axis 90C around which the rotor 60 and the drive shaft 90 are rotated. The orbiting scroll 66 moves about the central axis 90C in an eccentric orbit, i.e., in a circular motion while the orientation of the orbiting scroll 66 remains constant with respect to the fixed scroll 26. The center of the orbiting scroll 66 is located along an offset axis (not shown) of the drive shaft 90.

Generally, intermixed refrigerant and oil (at low pressure) enters the electric compressor 10 via a refrigerant inlet port (not shown) and exits the electric compressor 10 (at high pressure) via refrigerant outlet port (not shown) after being compressed by the compression device 18. Refrigerant follows a refrigerant path through the electric compressor 10. Refrigerant enters the refrigerant inlet port and enters an intake volume 74 formed between the motor side of the inverter housing 22 and the center housing 24 adjacent the refrigerant inlet port. Refrigerant is then drawn through the motor section 16 and enters a compression intake volume formed between an internal wall of the fixed scroll 26 and the orbiting scroll 66.

The fixed scroll 26 is mounted within the center housing 24. Refrigerant enters the compression device 12 from the compression intake volume. The fixed scroll 26 and the orbiting scroll 66 form compression chambers 80 in which low or unpressurized (saturation pressure) refrigerant enters from the compression device 12. As the orbiting scroll 66 moves to enable the compression chambers 80 to be closed off and the volume of the compression chambers is reduced to pressurize the refrigerant. At any one time during the cycle, one or more compression chambers 80 are at different stages in the compression cycle. During a cycle of the compressor 10, the refrigerant is transported towards the center of the compression chambers 80.

Returning to FIG. 1, the front cover 28 forms a discharge volume 82. The discharge volume 82 is in communication with the refrigerant output port. Pressurized refrigerant leaves the compression device 18 through one or more orifices (not shown). The release of pressurized refrigerant is controlled by a reed mechanism 86.

Passive Pressure System

With reference to FIGS. 2-10, in one aspect of the present invention, the compressor 10 includes a passive pressure system 150. As discussed above, the scroll-type electric compressor 10 is configured to compress a refrigerant, and may be utilized as a heat pump. The electric compressor 10 includes a housing 12, a refrigerant inlet port 68, a refrigerant outlet port 70, an inverter module 44, a motor 54, a drive shaft 90, a compression device 18, and the passive pressure system 150. The housing 12 has a generally cylindrical shape and defines the intake volume 74 and the discharge volume 82. The refrigerant inlet port 68 is coupled to the housing 12 and is configured to introduce the refrigerant to the intake volume 74. The refrigerant outlet port 70 is coupled to the housing 12 and is configured to allow compressed refrigerant to exit the scroll-type electric compressor 12 from the discharge volume 82. The inverter module 44 is mounted inside the housing 12 and is adapted to convert direct current electrical power to alternating current electrical power. The motor 54 is mounted inside the housing 12 and the drive shaft 90 is coupled to the motor 54.

Figure 2:
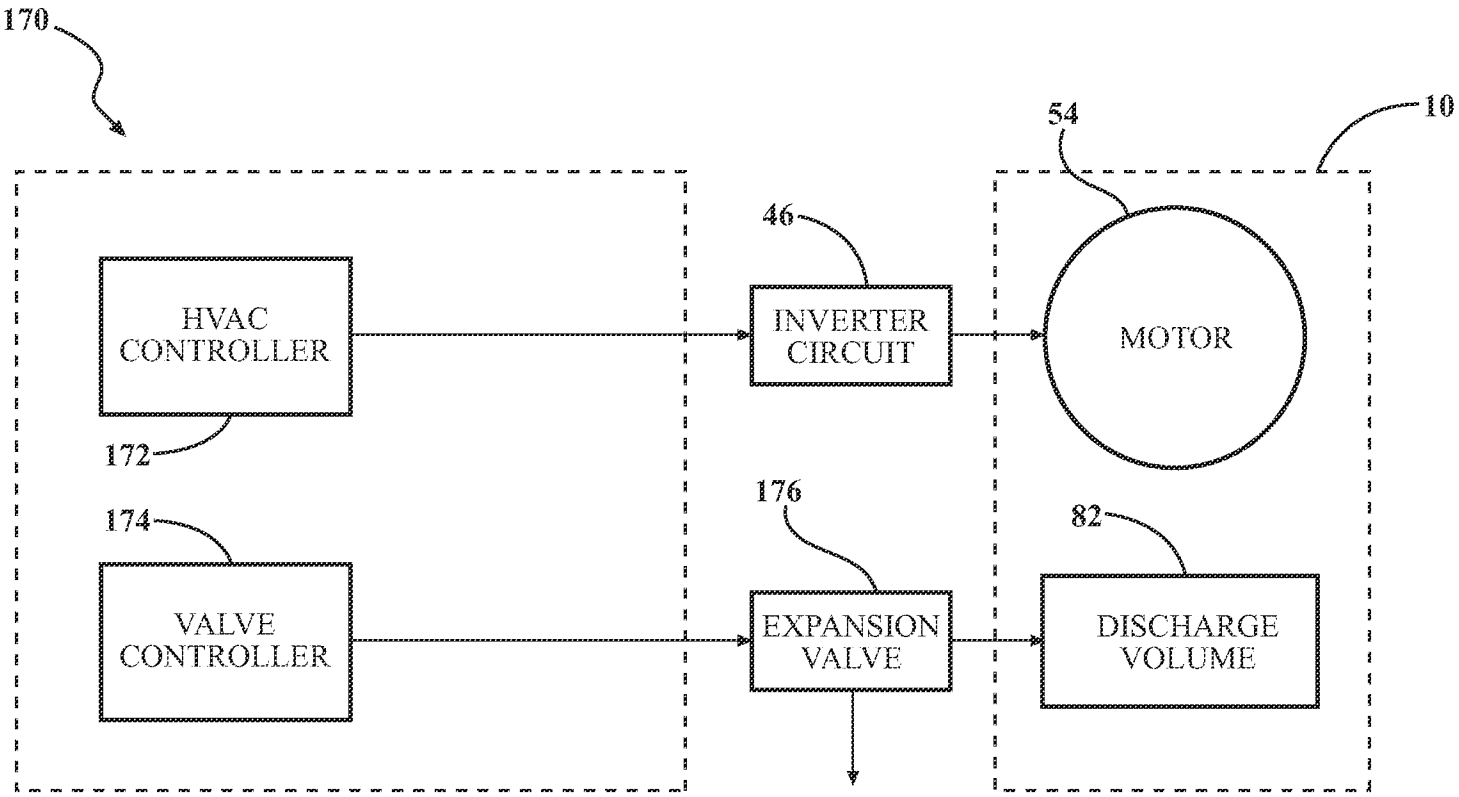
FIG. 2 is a block diagram of a control system for an electric compressor.

With specific reference to FIG. 2, operation of the electric compressor 10 may be controlled by a controller. The controller 170 may be external to the housing 12 and electrically connected to the inverter circuit 46 via the low voltage connector 52. Alternatively, the controller 170 may be provided within the housing 12, for example, within the inverter cavity 30. The controller 170 may implement an HVAC controller 172 and a valve controller 174. The HVAC controller 172 may provide instructions to the inverter circuit 46 to provide three-phase power to the motor 54 to control operation of the compressor 10. The valve controller 174 may be connected to an expansion valve 176 to controllably manage the flow of pressurized refrigerant from the discharge volume 82 of the compressor 10.

The compression device 18 may include a compression device body 19 and is coupled to the drive shaft 90. As discussed above, the compression device 19 is configured to receive the refrigerant from the intake volume 74 to compress the refrigerant as the drive shaft 90 is rotated by the motor 54. In the illustrated embodiment, the compression device body 19 at least partially defines the intake volume 74 and the discharge volume 82.

The passive pressure system 150, under predetermined conditions, may automatically open a high pressure region of the compressor 10, e.g., the discharge volume 82 and a low pressure region of the compressor 10, e.g., the intake volume 74. For example, the passive pressure system 150 may open automatically under predetermined high pressure ratios, for example, when the compressor 10 is operating as a heat pump. The passive pressure system 150 allows the expansion valve 176, under control of the valve controller 174, to be closed further than baseline operation resulting in reduced refrigerant pressure in the intake volume 74, i.e., suction pressure, and saturation temperature. This may cause a pressure differential across the discharge and intake volumes 82, 74 resulting in the opening of the passive pressure system 150. When the passive pressure system 150 is open compressed refrigerant from the discharge volume 82 is recycled into the intake volume 74 and recompressed. As discussed in more detail below, the passive pressure system 150, under predetermined conditions, automatically opens to between a high pressure region of the compressor 10, e.g., the discharge volume 82 and a low pressure region of the compressor 10, e.g., the intake volume 74. The passive pressure system 150 opens automatically under predetermined high-pressure ratios, for example, when the compressor 10 is operating as a heat pump. Refrigerant in the intake volume 74 will be a lower pressure and will extract additional heat from the ambient air. The recompressed refrigerant compounds compression losses and increase the temperature in the discharged refrigerant thereby increasing the capacity of the compressor 10.

Figure 3:
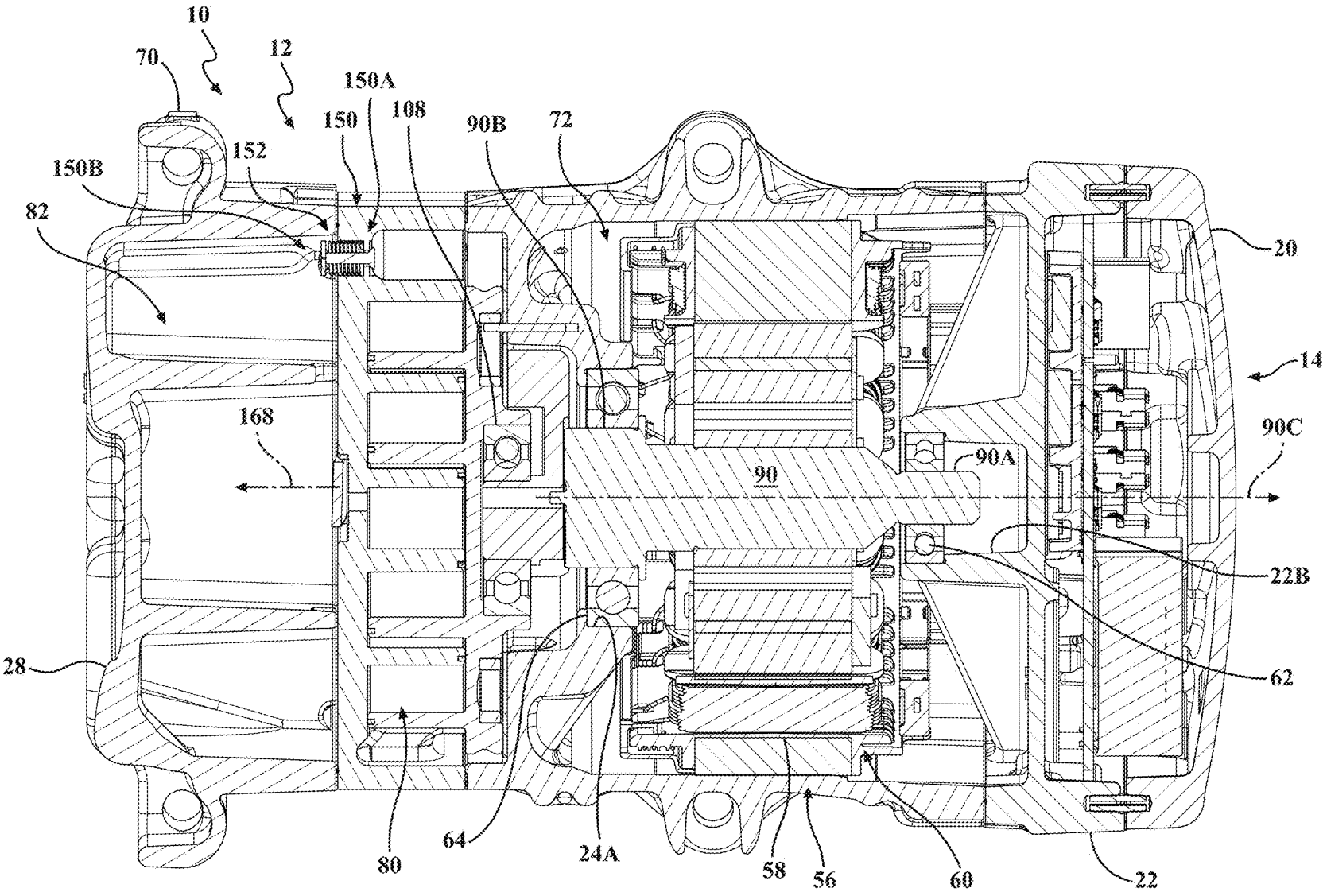
FIG. 3 is a cross-sectional view of the electric compressor, including a passive pressure system according to an embodiment of the present invention.
Figure 4:
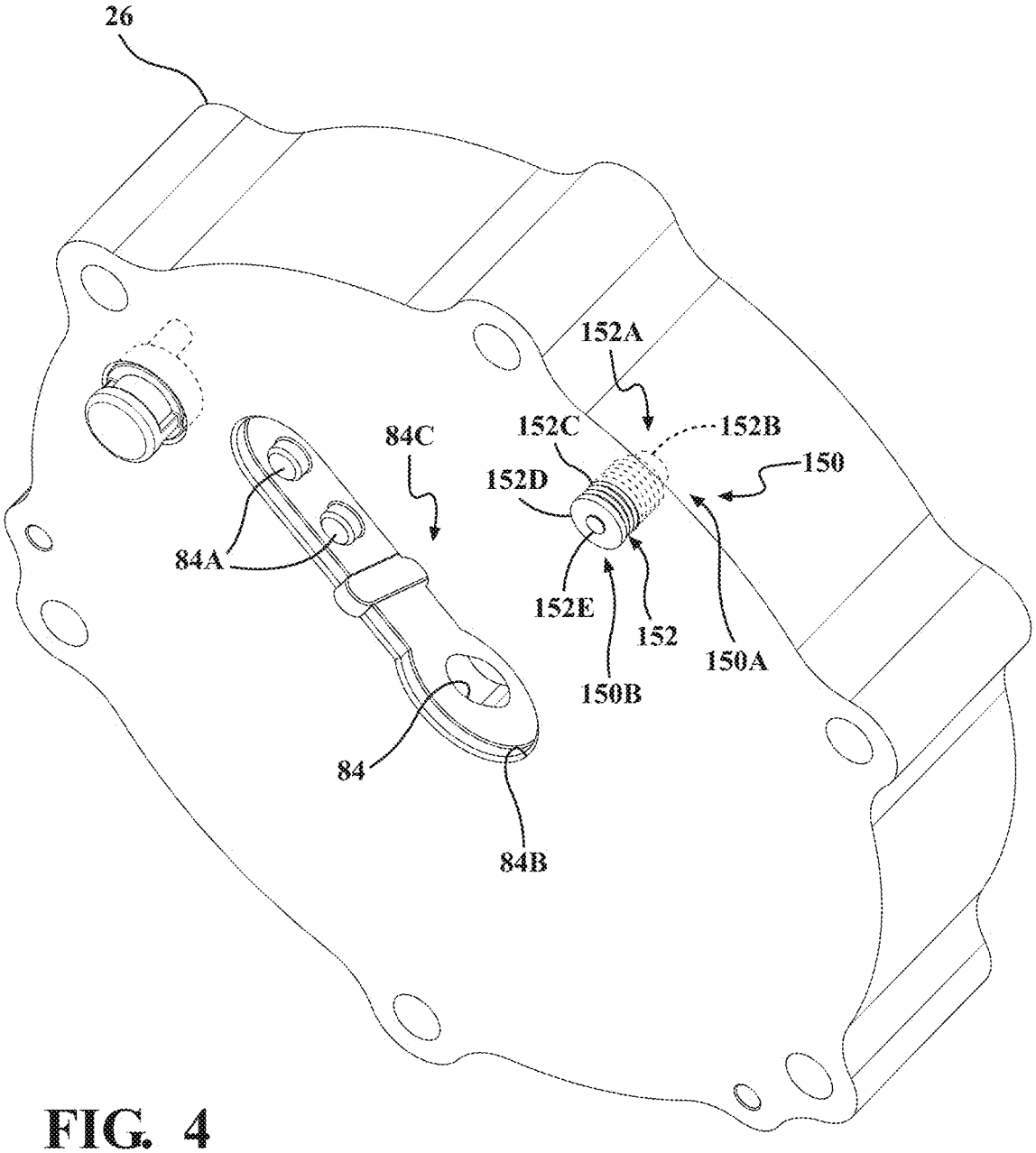
FIG. 4 is a first perspective view of a fixed scroll of the electric compressor of FIG. 1 and the passive pressure system of FIG. 3.

With particular reference to FIG. 3, the passive pressure system 150 may be located within the compression device body 19 and include a first end 150A and a second end 150B. As shown in the illustrated embodiment, the first end 150A is located adjacent the intake volume 74 and the second end 150B is located adjacent the discharge volume 82. The passive pressure system 150 is configured to automatically open a passage between the discharge volume 82 and the intake volume allowing compressed refrigerant to be recycled into the intake volume 74 in response to a predetermined pressure differential between the discharge volume and the intake volume.

As discussed above, and shown in FIG. 3, in the illustrated embodiment, the compression device 18 includes the fixed scroll 26 and the orbiting scroll 66. The fixed scroll 26 may form at least part of the compression device body 19. The fixed scroll 26 may be located within, and fixed relative to, the housing 12. The orbiting scroll 66 may be coupled to the drive shaft 90. As discussed above, the orbiting scroll 26 and the fixed scroll 66 may form compression chambers 80 for receiving the refrigerant from the intake volume 74 and compressing the refrigerant as the drive shaft 90 is rotated about the central axis 90C.

With particular reference to FIGS. 4-8, in one embodiment the passive pressure system 150 includes a spring valve 152. The fixed scroll 66 includes a first aperture 154. As shown, in the illustrated embodiment, the spring valve 152 is located within the first aperture 154.

Figure 10:
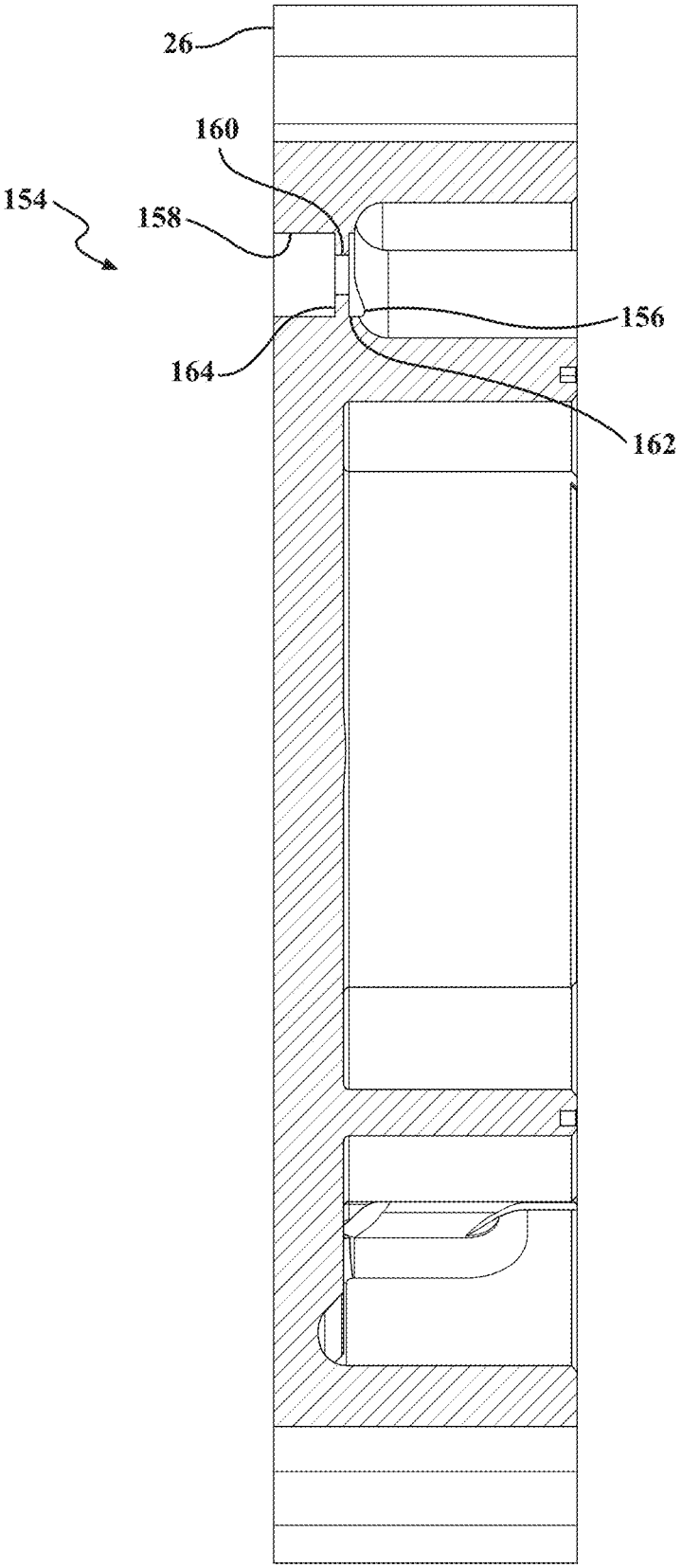
FIG. 10 is a cross-section view of the fixed scroll of FIG. 4.

As shown in FIG. 10, the first aperture 154 may include a first end portion 156 located adjacent the intake volume 74 and a second end portion 158 located adjacent the discharge volume 82. A middle portion 160 of the first aperture 154 connects the first end portion 156 and the second end portion 158. As shown, the first end portion 156 and the second end portion 158 have a diameter larger than a diameter of the middle portion 160.

Figure 5:
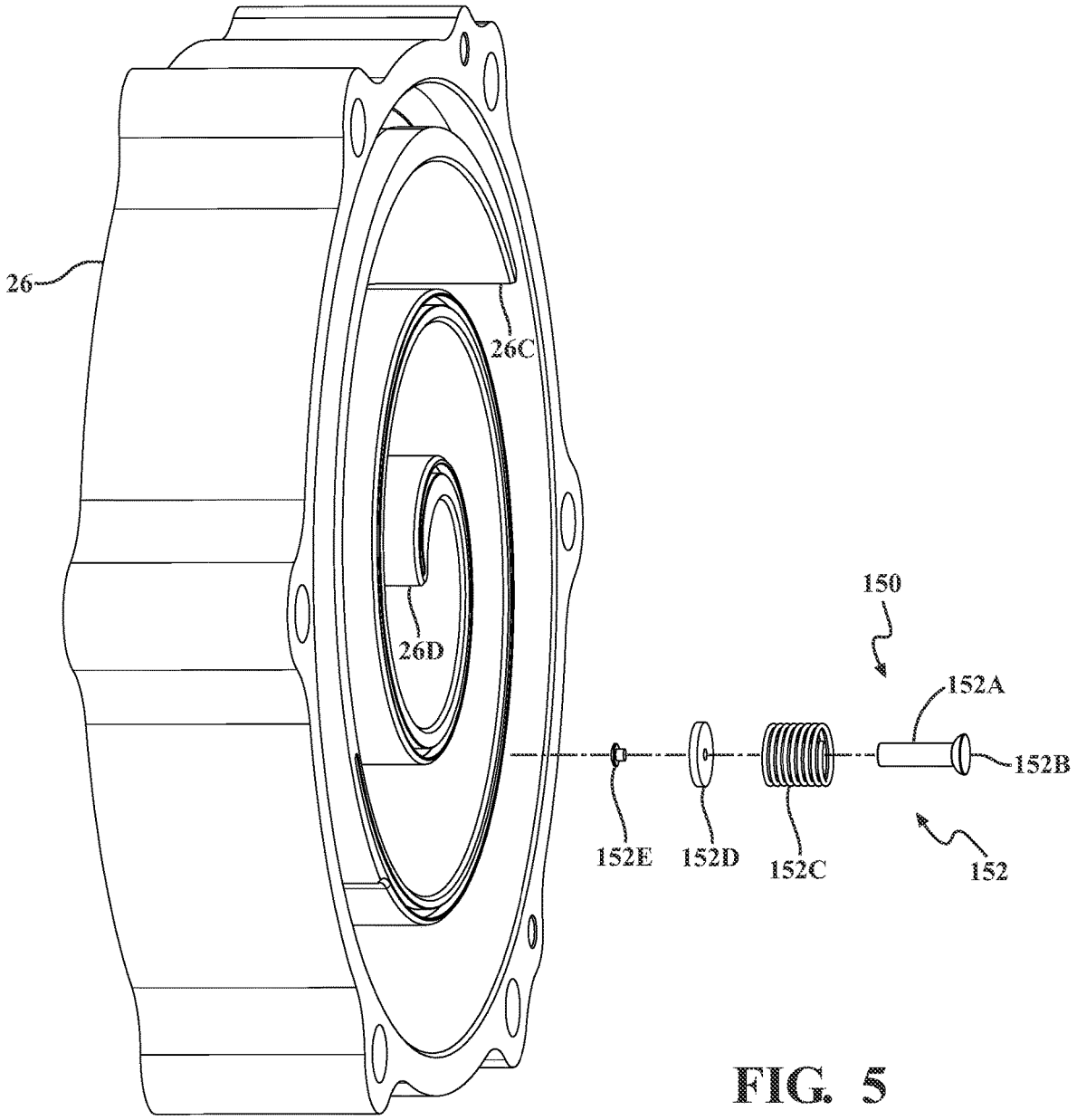
FIG. 5 is an exploded perspective view of the fixed scroll and passive pressure system of FIG. 4.
Figure 6:
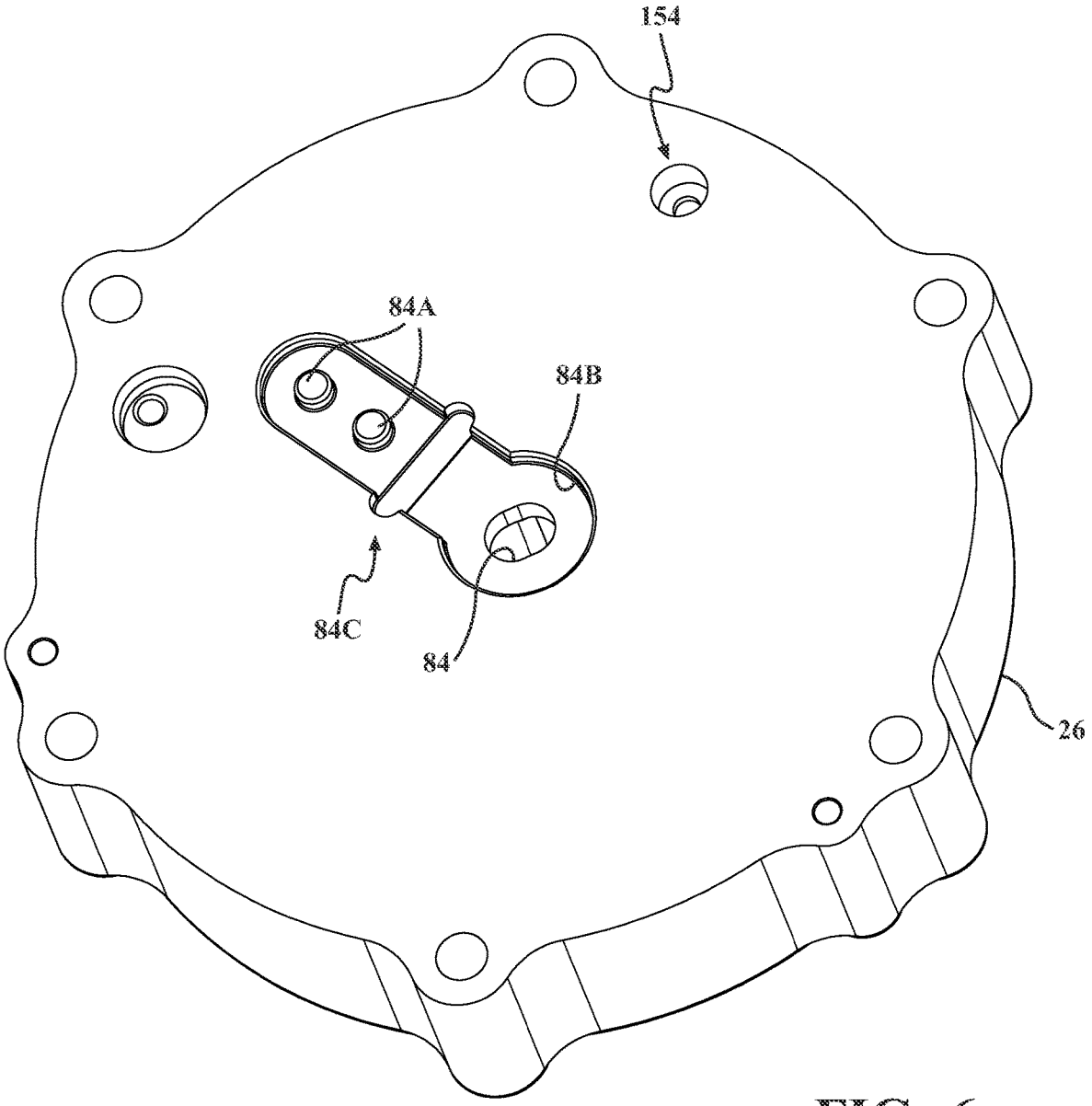
FIG. 6 is a perspective view of the fixed scroll of FIG. 4.
Figure 7:
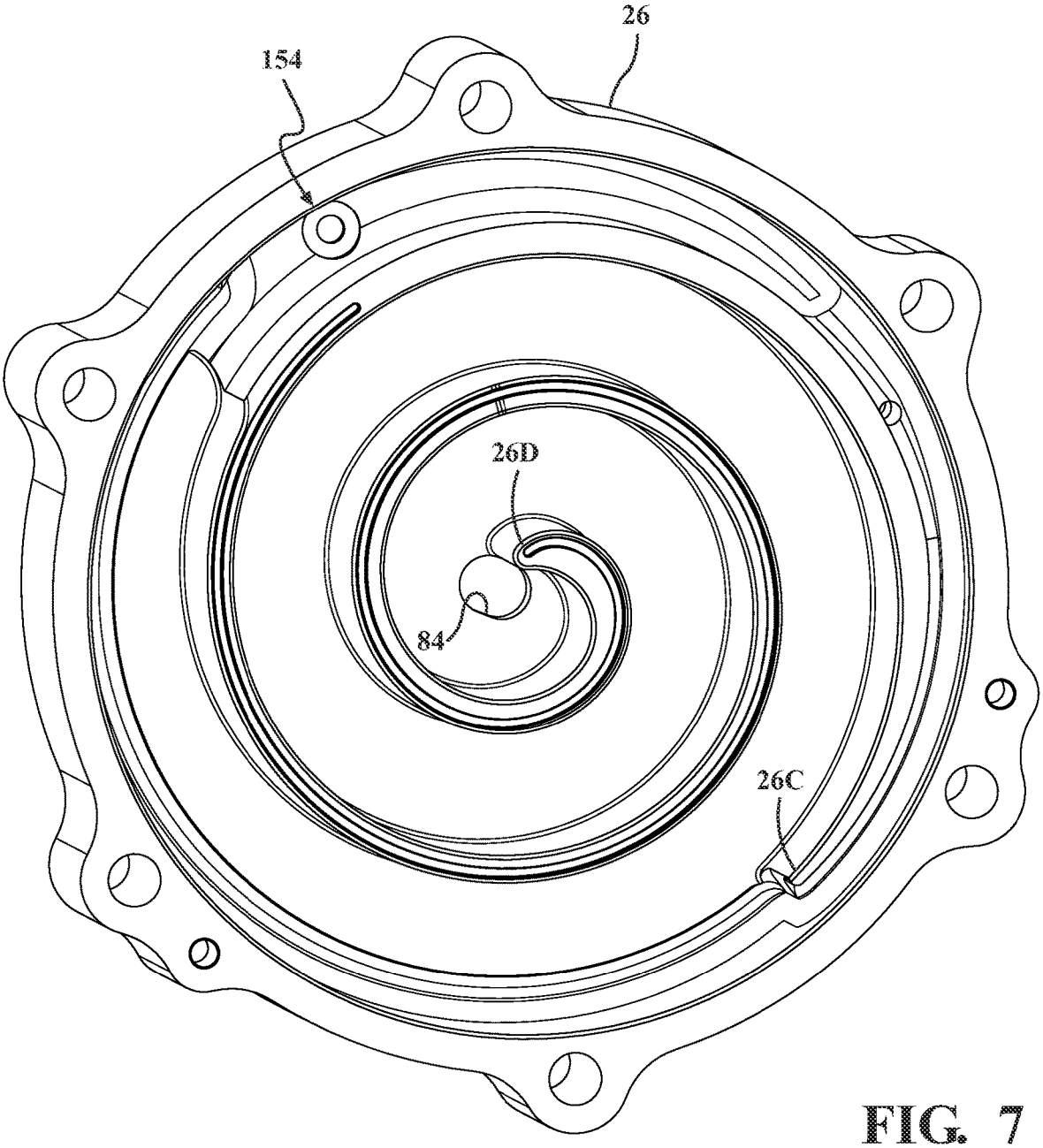
FIG. 7 is a second perspective view of the fixed scroll of FIG. 4.
Figure 8:
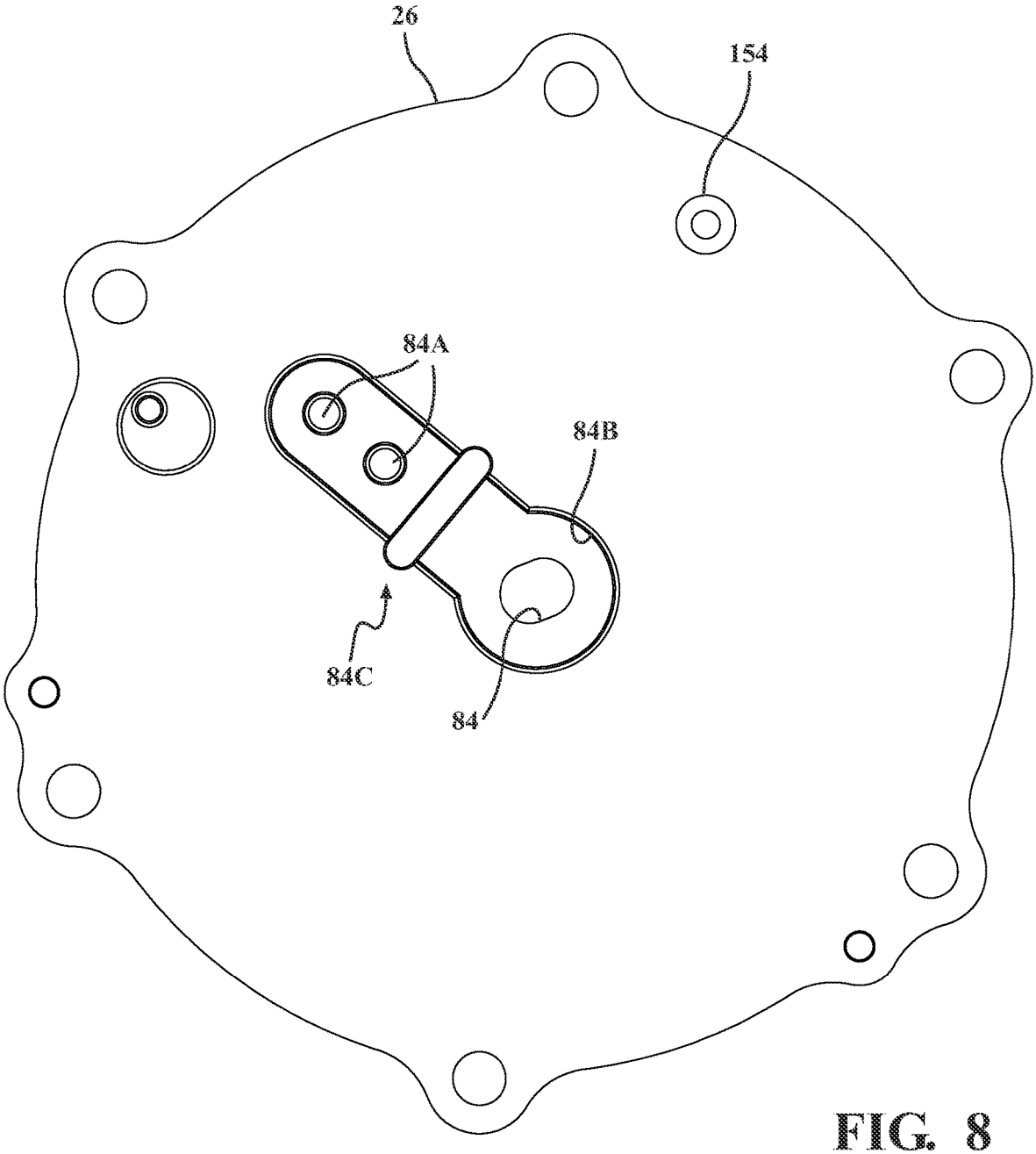
FIG. 8 is a third perspective view of the fixed scroll of FIG. 4.
Figure 9:
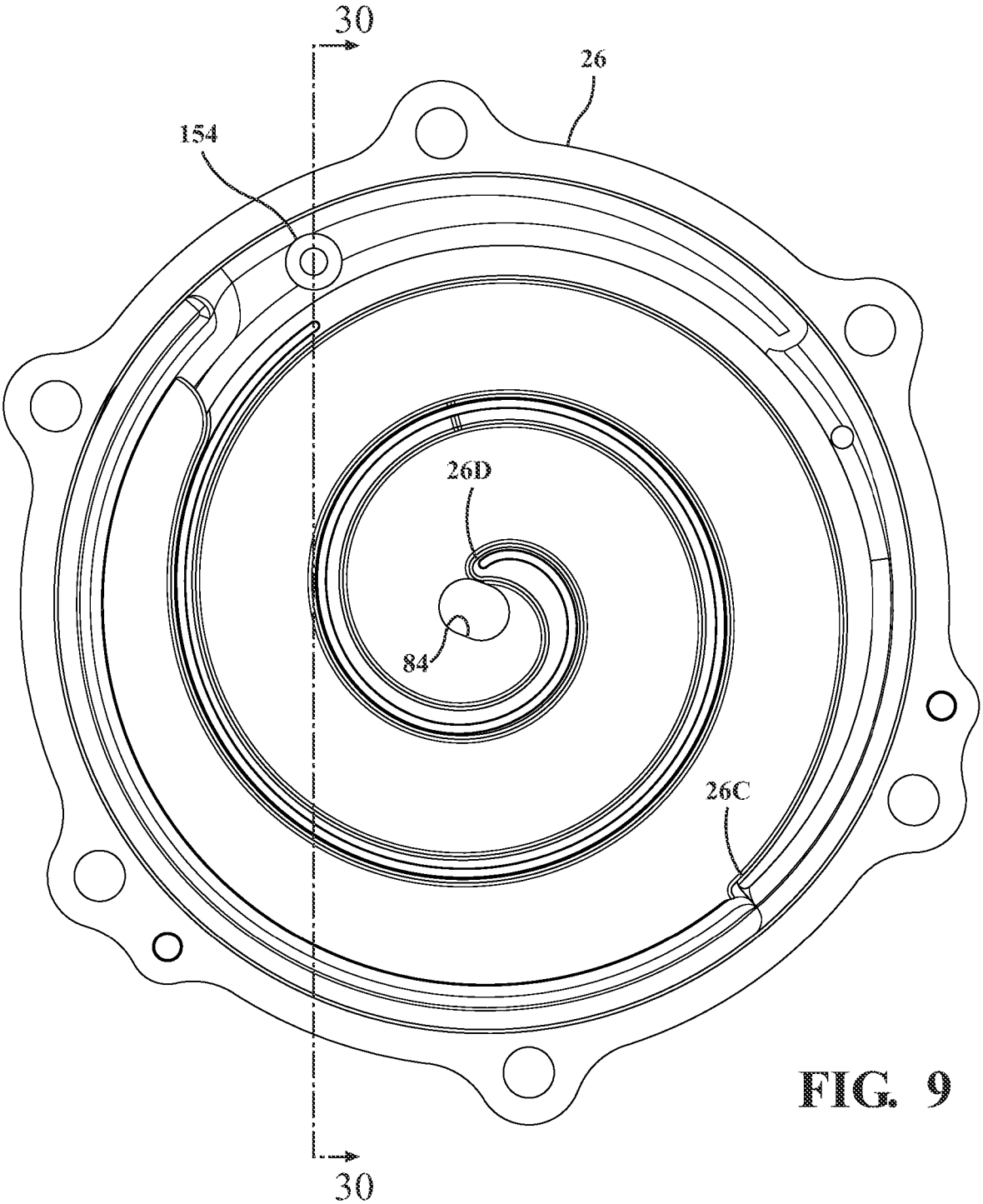
FIG. 9 is a rear view of the fixed scroll of FIG. 4.

With particular reference to FIG. 5, the spring valve 152 may include a valve stem 152A with an enlarged portion 152B at one end, a spring 152C, a retainer 152D, and a pin 154E. In the illustrated embodiment, the first end portion 156 and the middle portion 160 form a valve stem seat 162 and the second end portion 158 and the middle portion 160 form a spring seat 164. The valve stem 152 is positioned within the first aperture 154 with the enlarged portion 152B adjacent the valve stem seat 162. The spring 152C is located within the second end portion 158 of the first aperture 154. One end of the spring 152C is positioned against the spring seat 164. The retainer 152D is positioned at the opposite end of the spring 152 (see FIG. 4). The retainer 152D is coupled to an end of the valve stem 152A opposite the enlarged portion 152B of the valve stem 152A via the pin 152E. The pin 152E may be connected to an orifice (not shown) in the end of the valve stem 152 via a press-fit.

In the illustrated embodiment, the spring 152C biases the valve stem 152A towards a closed position. When the valve stem 152A is in the closed position, the enlarged portion 152B of the valve stem 152A is seated against the valve stem seat 162 blocking refrigerant from passing through the first aperture 154. In operation, during normal operation, i.e., the ratio of the discharge pressure versus suction pressure is less than the predetermined pressure ratio, the spring 152C retains the valve 152 in the closed position.

However, when the discharge pressure overcomes the predetermined pressure ratio, discharge pressure acts on the retainer 152D, moving the valve stem 152A and the enlarged portion 152B away from the valve stem seat 162, thereby allowing refrigerant to flow from the discharge volume 82 to the intake volume 74 through the first aperture 154.

In one aspect of the present invention, the compression device 18 has a main discharge outlet arranged to allow compressed refrigerant to flow from the compression device 18 to the discharge volume 82 (illustrated by arrow 168 in FIG. 3). The passive pressure system 150 defines a valve leak path through the first aperture 154 that is more restrictive than the main discharge outlet.

The foregoing invention has been described in accordance with the relevant legal standards, thus the description is exemplary rather than limiting in nature. Variations and modifications to the disclosed embodiment may become apparent to those skilled in the art and fall within the scope of the invention.

What is claimed is:

1. An electric compressor configured to compress a refrigerant and to be operated in a baseline operation mode and in a second operation mode, comprising:

a housing defining an intake volume and a discharge volume, the discharge volume being coupled to an expansion valve controllably operated by a valve controller, wherein pressure in the intake volume is reduced in response to limiting compressed refrigerant from exiting the discharge volume via closure of the expansion valve;

a refrigerant inlet port coupled to the housing and configured to introduce the refrigerant to the intake volume;

a refrigerant outlet port coupled to the housing and configured to allow compressed refrigerant to exit the electric compressor from the discharge volume;

an inverter module mounted inside the housing and adapted to convert direct current electrical power to alternating current electrical power;

a motor mounted inside the housing;

a drive shaft coupled to the motor;

a compression device having a compression device body and being coupled to the drive shaft, for receiving the refrigerant from the intake volume and compressing the refrigerant as the drive shaft is rotated by the motor, the compression device body at least partially defining the intake volume and the discharge volume; and, a passive pressure system located within the compression device body and having a first end located adjacent the intake volume and a second end being located adjacent the discharge volume, the passive pressure system being closed, and the expansion valve being open during baseline operation of the electric compressor, the passive pressure system being configured to automatically open a passage between the discharge volume and the intake volume in response to a predetermined pressure differential between the discharge volume and the intake volume resulting in operation electric compressor in the second operation mode, wherein compressed refrigerant is recycled into the intake volume while the electric compressor is operating in the second operation mode compounding compression losses and increasing a temperature of the discharged refrigerant exiting the electric compressor.

2. The electric compressor, as set forth in claim 1, wherein the compression device includes:

a fixed scroll located within, and being fixed relative to, the housing;

an orbiting scroll coupled to the drive shaft, the orbiting scroll and the fixed scroll forming compression chambers for receiving the refrigerant from the intake volume and compressing the refrigerant as the drive shaft is rotated about the central axis, wherein the fixed scroll forms at least a portion of the compression device body.

3. The electric compressor, as set forth in claim 2, where the passive pressure system includes a spring valve.

4. The electric compressor, as set forth in claim 3, wherein the spring valve includes a spring and a valve stem arranged to bias the valve stem of the valve towards a closed position.

5. The electric compressor, as set forth in claim 2 the housing defining a motor cavity for housing the motor, the fixed scroll forming part of the housing.

6. The electric compressor, as set forth in claim 1, wherein the compression device includes a main discharge outlet arranged to allow compressed refrigerant to flow from the compression device to the discharge volume.

7. The electric compressor, as set forth in claim 6, wherein the passive pressure system defines a valve leak path that is more restrictive than the main discharge outlet.

8. The electric compressor, as set forth in claim 1, wherein the housing includes first drive shaft supporting member and a second drive shaft supporting member and further including:

a first ball bearing located within the first drive shaft supporting member and configured to receive the first end of the drive shaft; and, second ball bearing located within the second drive shaft supporting member and configured to receive the second end of the drive shaft.

9. An A electric compressor having a central axis and being configured to compress a refrigerant, comprising:

a housing defining an intake volume and a discharge volume;

a refrigerant inlet port coupled to the housing and configured to introduce the refrigerant to the intake volume;

a refrigerant outlet port coupled to the housing and configured to allow compressed refrigerant to exit the electric compressor from the discharge volume;

an inverter section including:

an inverter housing, an inverter back cover connected to the inverter housing and forming an inverter cavity, and, an inverter module mounted inside the inverter cavity and adapted to convert direct current electrical power to alternating current electrical power;

a motor section including:

a motor housing forming a motor cavity and being mounted to the inverter housing, a drive shaft located within the motor housing having a central axis, and a motor located within the motor housing to controllably rotate the drive shaft about the central axis, and, a compression device including:

a fixed scroll located within, and being fixed relative to, the housing, and an orbiting scroll coupled to the drive shaft, the orbiting scroll and the fixed scroll forming compression chambers for receiving the refrigerant from the intake volume and compressing the refrigerant as the drive shaft is rotated about the central axis; and, a passive pressure system located within the compression device body and having a first end located adjacent the intake volume and a second end being located adjacent the discharge volume, the passive pressure system being closed, and the expansion valve being open during baseline operation of the electric compressor, the passive pressure system being configured to automatically open a passage between the discharge volume and the intake volume in response to a predetermined pressure differential between the discharge volume and the intake volume resulting in operation electric compressor in the second operation mode, wherein compressed refrigerant is recycled into the intake volume while the electric compressor is operating in the second operation mode compounding compression losses and increasing a temperature of the discharged refrigerant exiting the electric compressor.

10. The electric compressor, as set forth in claim 9, wherein the fixed scroll forms at least a portion of the compression device body.

11. The electric compressor, as set forth in claim 10, where the passive pressure system includes a spring valve.

12. The electric compressor, as set forth in claim 11, wherein the spring valve includes a spring and a valve stem arranged to bias the valve stem of the valve towards a closed position.

13. The electric compressor, as set forth in claim 10 the housing defining a motor cavity for housing the motor, the fixed scroll forming part of the housing.

14. The electric compressor, as set forth in claim 9, wherein the compression device includes a main discharge outlet arranged to allow compressed refrigerant to flow from the compression device to the discharge volume.

15. The electric compressor, as set forth in claim 14, wherein the passive pressure system defines a valve leak path that is more restrictive than the main discharge outlet.

16. The electric compressor, as set forth in claim 9, wherein the housing includes first drive shaft supporting member and a second drive shaft supporting member and further including:

a first ball bearing located within the first drive shaft supporting member and configured to receive the first end of the drive shaft; and, second ball bearing located within the second drive shaft supporting member and configured to receive the second end of the drive shaft.

17. An electric compressor configured to compress a refrigerant and to be operated in a baseline operation mode and in a second mode, comprising:

a housing defining an intake volume and a discharge volume, the discharge volume being coupled to an expansion valve controllably operated by a valve controller, wherein pressure in the intake volume is reduced in response to limiting compressed refrigerant from exiting the discharge volume via closure of the expansion valve;

a refrigerant inlet port coupled to the housing and configured to introduce the refrigerant to the intake volume;

a refrigerant outlet port coupled to the housing and configured to allow compressed refrigerant to exit the electric compressor from the discharge volume;

a compression device having a compression device body and configured to receive and compress the refrigerant from the intake volume, the compression device body at least partially defining the intake volume and the discharge volume; and, a passive pressure system located within the compression device and having a first end located adjacent the intake volume and a second end being located adjacent the discharge volume, the passive pressure system being closed, and the expansion valve being open during baseline operation of the electric compressor, the passive pressure system being configured to automatically open a passage between the discharge volume and the intake volume in response to a predetermined pressure differential between the discharge volume and the intake volume resulting in operation electric compressor in the second operation mode, wherein compressed refrigerant is recycled into the intake volume while the electric compressor is operating in the second mode compounding compression losses and increasing a temperature of the discharged refrigerant exiting the electric compressor.

18. A system, comprising:

an electric compressor configured to compress a refrigerant and to be operated in a baseline operation mode and in a second mode, including:

a housing defining an intake volume and a discharge volume, a refrigerant inlet port coupled to the housing and configured to introduce the refrigerant to the intake volume, a refrigerant outlet port coupled to the housing and configured to allow compressed refrigerant to exit the electric compressor from the discharge volume;

a drive shaft coupled to a motor;

a compression device having a compression device body and being coupled to the drive shaft, for receiving the refrigerant from the intake volume and compressing the refrigerant as the drive shaft is rotated by the motor, the compression device body at least partially defining the intake volume and the discharge volume;

a passive pressure system; and, an expansion valve coupled to the electric compressor and configured to controllably reduce a flow of compressor refrigerant from the discharge volume, wherein pressure in the intake volume is reduced in response to limiting compressed refrigerant from exiting the discharge volume via closure of the expansion valve, the passive pressure system located within the compression device body and having a first end located adjacent the intake volume and a second end being located adjacent the discharge volume, the passive pressure system being closed, and the expansion valve being open during baseline operation of the electric compressor, the passive pressure system being configured to automatically open a passage between the discharge volume and the intake volume in response to a predetermined pressure differential between the discharge volume and the intake volume resulting in operation electric compressor in the second mode, wherein compressed refrigerant is recycled into the intake volume while the electric compressor is operating in the second mode compounding compression losses and increasing a temperature of the discharged refrigerant exiting the electric compressor.

* * * * *